US012226054B2

(12) United States Patent
DiMaria et al.

(10) Patent No.: US 12,226,054 B2
(45) Date of Patent: Feb. 18, 2025

(54) TOWEL BACK

(71) Applicants: Diana DiMaria, Totowa, NJ (US); Jayson DiMaria, Totowa, NJ (US)

(72) Inventors: Diana DiMaria, Totowa, NJ (US); Jayson DiMaria, Totowa, NJ (US)

( * ) Notice: Subject to any disclaimer, the term of this patent is extended or adjusted under 35 U.S.C. 154(b) by 684 days.

(21) Appl. No.: 17/402,556

(22) Filed: Aug. 15, 2021

(65) Prior Publication Data

US 2021/0386250 A1 Dec. 16, 2021

Related U.S. Application Data

(63) Continuation of application No. 29/652,225, filed on Jun. 16, 2020, now Pat. No. Des. 940,438.

(51) Int. Cl.
*A47K 10/02* (2006.01)
*A41D 20/00* (2006.01)

(52) U.S. Cl.
CPC ..... *A47K 10/025* (2013.01); *A41D 20/00* (2013.01)

(58) Field of Classification Search
CPC ..... A47K 10/025; A41D 20/00
USPC ..... 34/96
See application file for complete search history.

(56) References Cited

U.S. PATENT DOCUMENTS 1,610,480 A * 12/1926 Seilaz ..... A45D 8/40 132/274
1,948,556 A * 2/1934 Armsby ..... A45D 8/40 2/174
4,669,128 A 1/1987 Furgang
5,062,157 A 11/1991 Muta
5,685,016 A * 11/1997 Douglas ..... A41D 23/00 2/202
5,708,982 A 1/1998 Armani
6,425,795 B1 * 7/2002 Horsfall ..... A63H 3/02 446/385
6,718,554 B1 4/2004 Langston
(Continued)

FOREIGN PATENT DOCUMENTS

CA 2921689 A1 * 9/2017
JP 6-41611 6/1994
(Continued)

OTHER PUBLICATIONS

Thick Coral Velvet Bathroom Hair Drying Set of 3 Hair Towel/Dryer Cap/Headband Water Magnet Absorption Microfiber Accessories, Diniwell Store, Model No. LT000102563 (accessed Feb. 2020).

(Continued)

*Primary Examiner* — Stephen M Gravini

(57) ABSTRACT

The Towel Back is a towel with a headband and a waterproof liner that lays across the shoulders and back of a user. The headband allows the towel to be kept in place without holding it with one's hands. The towel portion absorbs the water from the wet hair, but the waterproof liner prevents the wet hair from seeping through the towel onto the user's back or shirt. Because of the unique features of the Towel Back, the Towel Back allows a user to go about their activities while their hair dries naturally and prevents the user's clothing (shirt, pajamas, etc.) from getting wet. For those who go to sleep with their hair wet, the Towel Back can also serve as a protector between the wet hair and a pillow.

13 Claims, 7 Drawing Sheets

(56) References Cited

U.S. PATENT DOCUMENTS

| | | | | |
|---|---|---|---|---|
| 7,412,729 | B1 * | 8/2008 | McGovern | A42B 1/041 2/202 |
| 9,226,626 | B2 * | 1/2016 | Sprague | A47K 10/02 |
| 9,591,882 | B2 * | 3/2017 | Duffin | A42B 3/0406 |
| 9,907,381 | B2 * | 3/2018 | Tussey | A42B 1/049 |
| D836,302 | S * | 12/2018 | Alba | D2/867 |
| D871,727 | S | 1/2020 | Amato | |
| D940,438 | S * | 1/2022 | DiMaria | A47K 10/025 D2/877 |
| 11,363,870 | B1 * | 6/2022 | Cohen | A42B 1/041 |
| 2013/0247269 | A1 * | 9/2013 | Alburg | A42B 1/12 2/202 |
| 2016/0345640 | A1 | 12/2016 | Betts | |
| 2021/0386250 | A1 * | 12/2021 | DiMaria | A47K 10/025 |

FOREIGN PATENT DOCUMENTS

| | | |
|---|---|---|
| JP | 7-30901 | 6/1995 |
| JP | 9-252830 | 9/1997 |
| JP | 2002-242019 | 8/2002 |
| JP | 2008-49096 | 3/2008 |
| WO | 2006080096 A1 | 8/2006 |
| WO | 2009027699 | 5/2009 |

OTHER PUBLICATIONS

Design U.S. Appl. No. 29/652,225, filed Jun. 16, 2020 (copy attached).

* cited by examiner

TOWEL BACK

CROSS REFERENCE OF RELATED APPLICATIONS

The present application claims the benefit of U.S. Provisional Patent Application No. 62/705,203, filed on Jun. 16, 2020, and also claims the benefit of priority of U.S. Design patent application No. 29/652,225, filed on Jun. 16, 2020, the entire contents of each of which are hereby incorporated by reference herein in their entireties, as if set forth fully herein.

FIELD OF THE INVENTION

The present invention relates to a hair towel for allowing hair to dry naturally and providing a secure fit on the head of the wearer so that the activity and movement of the wearer is not restricted.

BACKGROUND OF THE INVENTION

There are many advantages and benefits to allowing hair to dry naturally. A natural drying process does not damage the hair as would, for example, an electric blow dryer, especially if the hair has been chemically treated. The hair exposed to the electric heat may become brittle, split at its ends or otherwise become damaged. Furthermore, using electric blow dryers can leave the hair frizzy and straighten otherwise natural curly or adversely affect a permanent wave (also known as a perm).

Use of electric blow dryers confines a user to a location near an electrical outlet. Furthermore, the user's activity is limited to only drying one's hair when using an electric blow dryer.

Active towel drying overcomes many of the disadvantages of electric blow dryers. Towel drying does not damage the hair, keeping the hair healthy. However, active towel drying takes time and prevents the user from performing other tasks.

In the past, rectangular towels have been used to dry one's hair by wrapping the towel around the head like a turban and attempting to hold the towel in place by tucking one end under another. To overcome this, towel wraps, sleeves and the like have been designed to envelop the user's hair to absorb any liquid. These wraps, sleeves and other can be cumbersome to use, especially for young children. See U.S. Pat. No. 9,907,381. In many instances, these alternatives fail to remain in place on the user's head, especially if the user is engaged in physical activity, movement.

There is a need for a convenient hair towel that overcomes the disadvantages of electric blow dryers, towel wraps, sleeves and is simple to use, allowing freedom of movement and activity for the wearer.

SUMMARY OF THE INVENTION

The present invention overcomes the disadvantages of electric blow dryers and the various wraps, sleeves and the like. Examples aspects herein can be useful for individuals, including by example and without limitation, those with longer hair, who dislike the feeling that wet hair leaves on their back or clothing after a shower or swimming. In one example embodiment herein, a Towel Back is provided that includes a towel with a headband and a waterproof liner that lays across the shoulders and back of a user. The headband allows the towel to be kept in place without holding it with one's hands. The towel portion absorbs the water from the wet hair, but the waterproof liner prevents the wet hair from seeping through the towel onto the user's back or shirt/clothing. Because of the unique features of the Towel Back, the Towel Back allows a user to go about their activities while their hair dries naturally and prevents the user's clothing (shirt, pajamas, etc.) from getting wet. For those who go to sleep with their hair wet, the Towel Back can also serve as a protector between the wet hair and a pillow.

According to one example embodiment herein, the Towel Back is a wearable towel for use in the drying of a user's hair. The towel has a general shape to covering the neck, shoulders and back of the user having a top side, a bottom side and non-parallel sides. The towel further includes a front side made of an absorbent material, an underside consisting of a waterproof material permanently attached to the top side of the towel, an elastic headband attached to the top side of the towel to be positioned along the user's hairline, and a sleeve made of the same material as the front side that covers the elastic headband and is attached to the top side of the towel. The top side is shorter than the bottom side.

The elastic headband has a first and second end having complementary patches of a hook and loop fastener material (e.g., Velcro or the like), allowing the headband to be adjustable to fit the circumference of the user's head. In another example embodiment herein, the headband is a closed loop configuration.

The wearable towel's shape, in one non-limiting example embodiment herein, is one of an isosceles trapezoid where the non-parallel sides flare such that the top side is narrower than the bottom side and the non-parallel sides include a bend altering the angle of the non-parallel sides.

In another example embodiment herein, the elastic headband is a closed loop sized to stretch and fit around the circumference of the user's head.

In yet another embodiment herein, the wearable towel includes animal ears attached to the sleeve and corresponding tail attached to the bottom side, wherein the animal ears and tail are made from the same material as the front side.

BRIEF DESCRIPTION OF THE DRAWINGS

The present invention will now be better understood with reference to the description and to the accompanying drawings in which.

In these figures, preferred embodiments of the invention are illustrated by way of examples. It is to be expressly understood that the description and drawings are only for the purpose of illustration and are an aid for understanding. They are not intended to define the limits of the invention.

DETAILED DESCRIPTION OF THE PREFERRED EMBODIMENTS

As used herein, any usage of terms that suggest an absolute orientation (e.g. "top," "bottom," "back," "front," "rear," etc.) are for illustrative convenience and refer to a specific orientation. However, such terms are not to be construed in a limiting sense as it is contemplated that various components will, in practice, be utilized in orientations that are the same as, or different than those described or shown.

Figure 1:
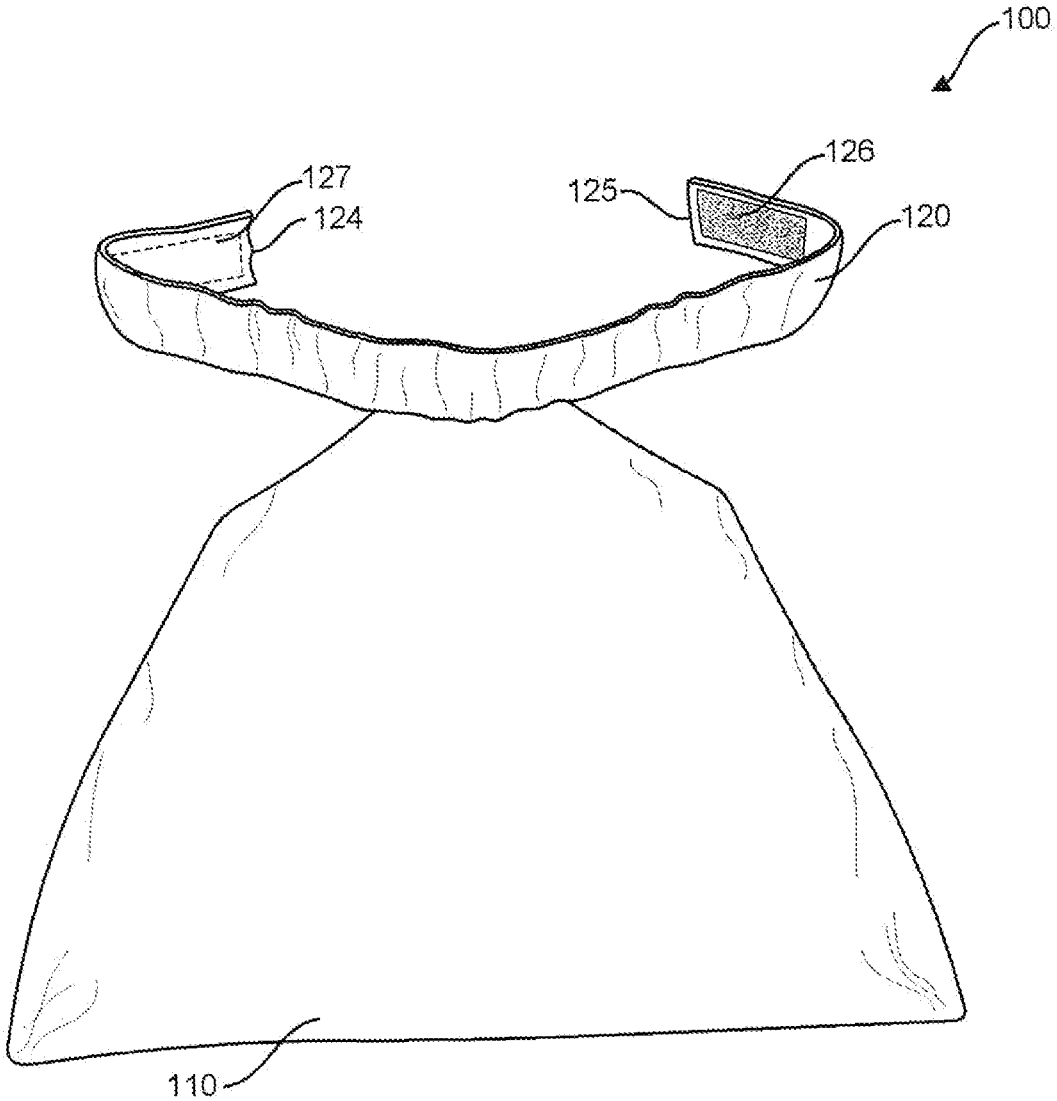
FIG. 1 is a perspective view of an embodiment of the Towel Back.
Figure 2:
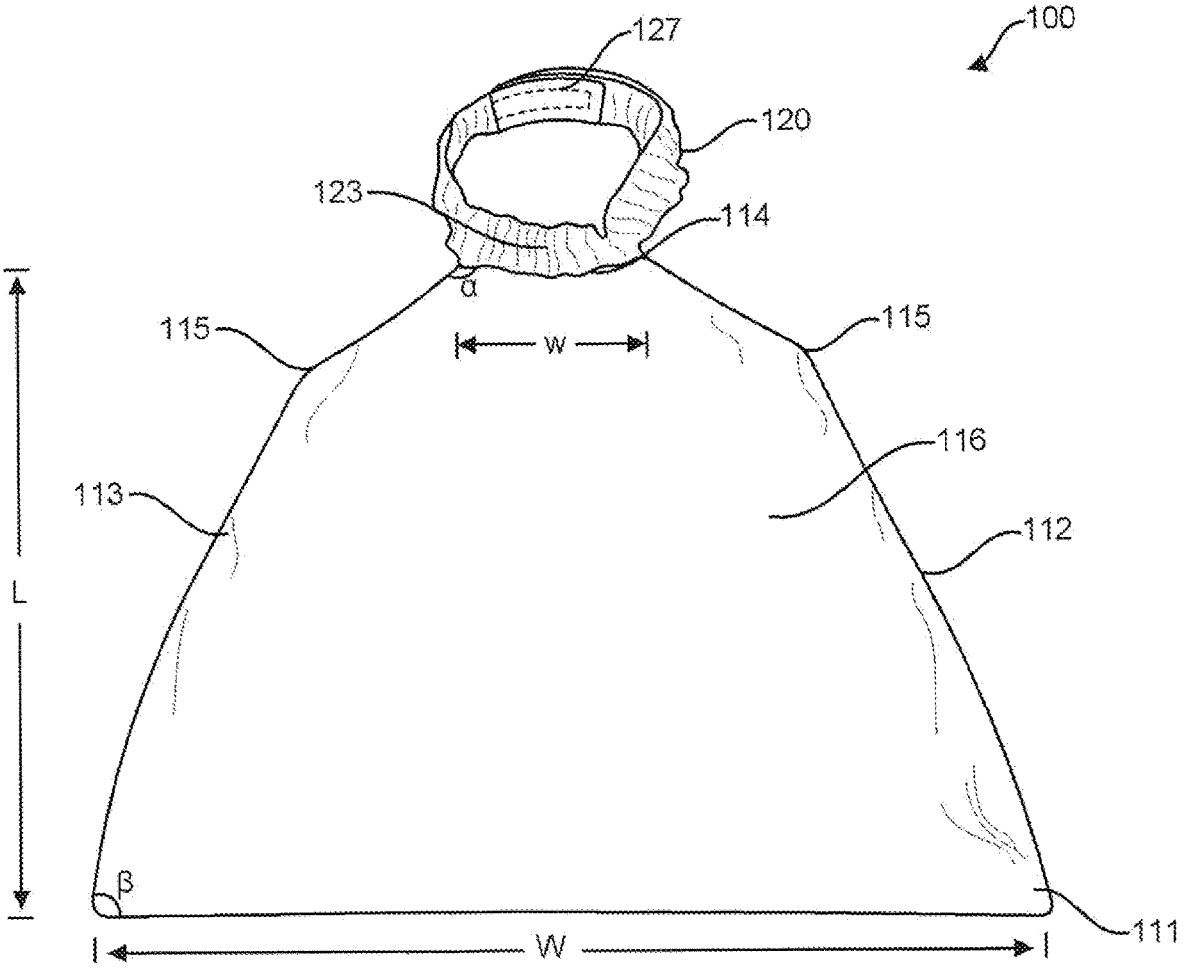
FIG. 2 is another perspective view of the embodiment depicted in FIG. 1 with the headband closed.
Figure 5:
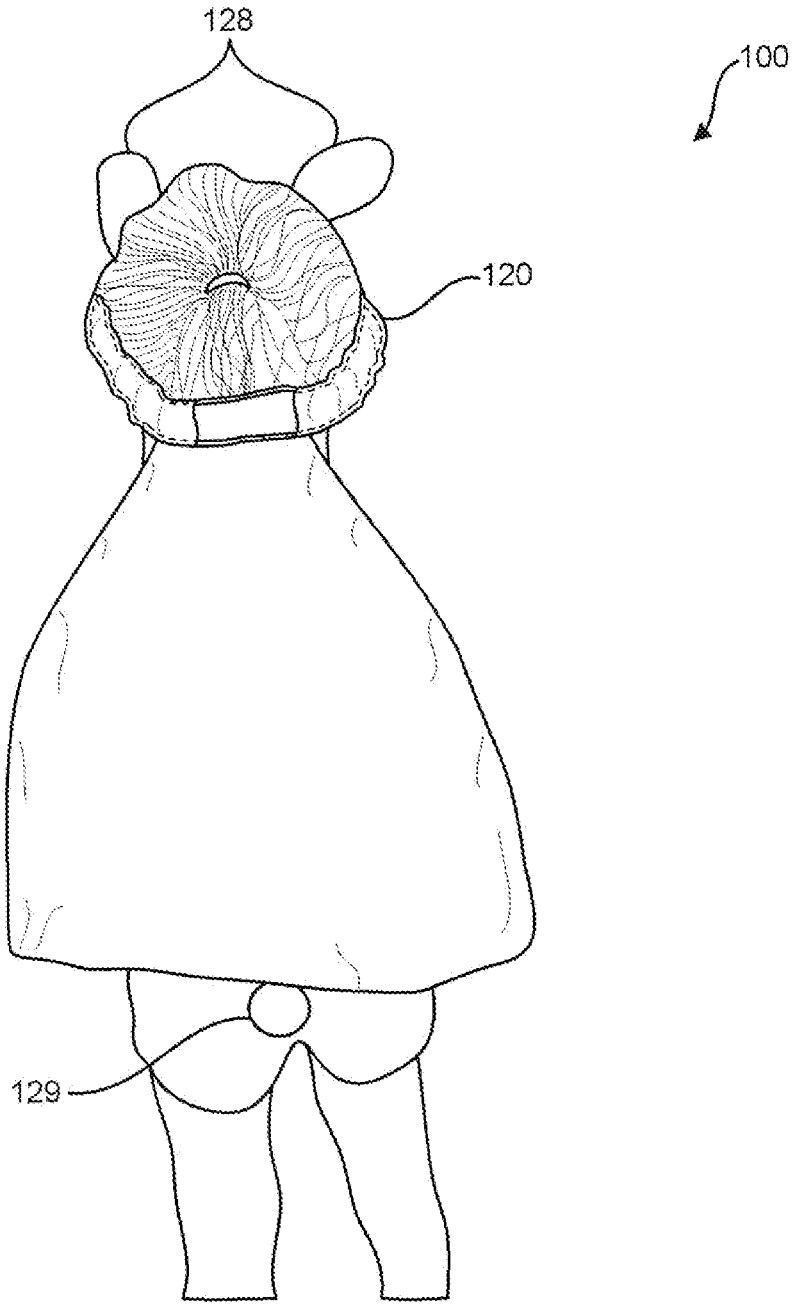
FIG. 5 is a back/rear view of the Towel Back embodiment depicted in FIG. 1 worn by a user with an animal tail attached.
Figure 6:
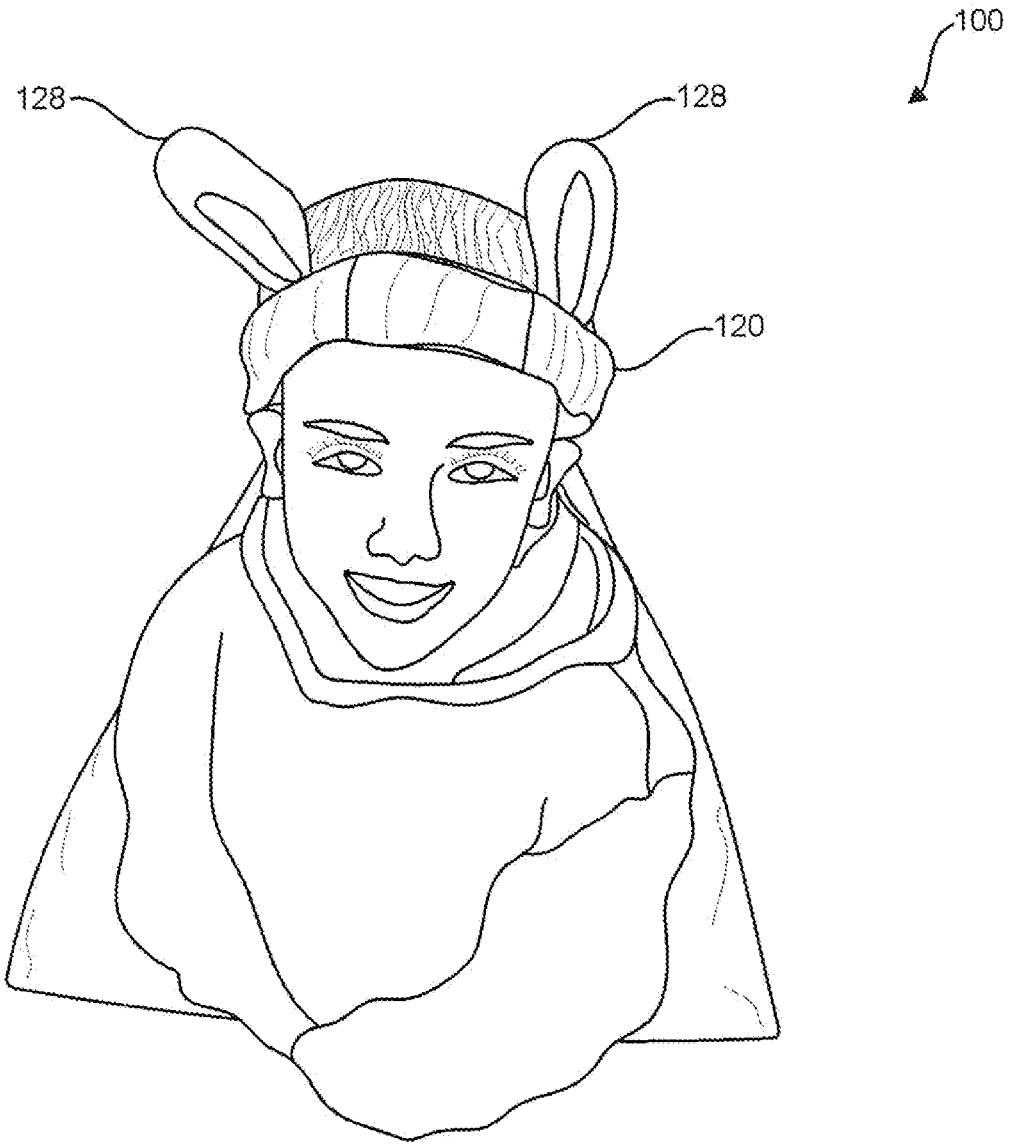
FIG. 6 is a front view of the Towel Back embodiment depicted in FIG. 1 with animal ears attached to the headband.

Turning now to the figures, FIG. 1 is a perspective view of the Towel Back (100), comprising a wearable towel (110) with an elastic headband (120) to keep the Towel Back secured to either the head or neck/shoulders of the user. When worn (see FIGS. 4 thru 6), preferably the elastic headband (120) wraps around the head of the user, such that the elastic headband (120) is positioned just at the hairline of the user as the headband also serves to hold the hair away from the face. The wearable towel (110) drapes down over the shoulders and back of the user such that the wearable towel (110) is positioned between the body and hair of the user. The hair thus rests on the wearable towel (110). It is envisioned that the Towel Back comes in multiple sizes, preferably Small, Medium and Large. The sizing is determined by the length (L) and bottom width (W) of the wearable towel (110) (see FIG. 2).

Figure 3:
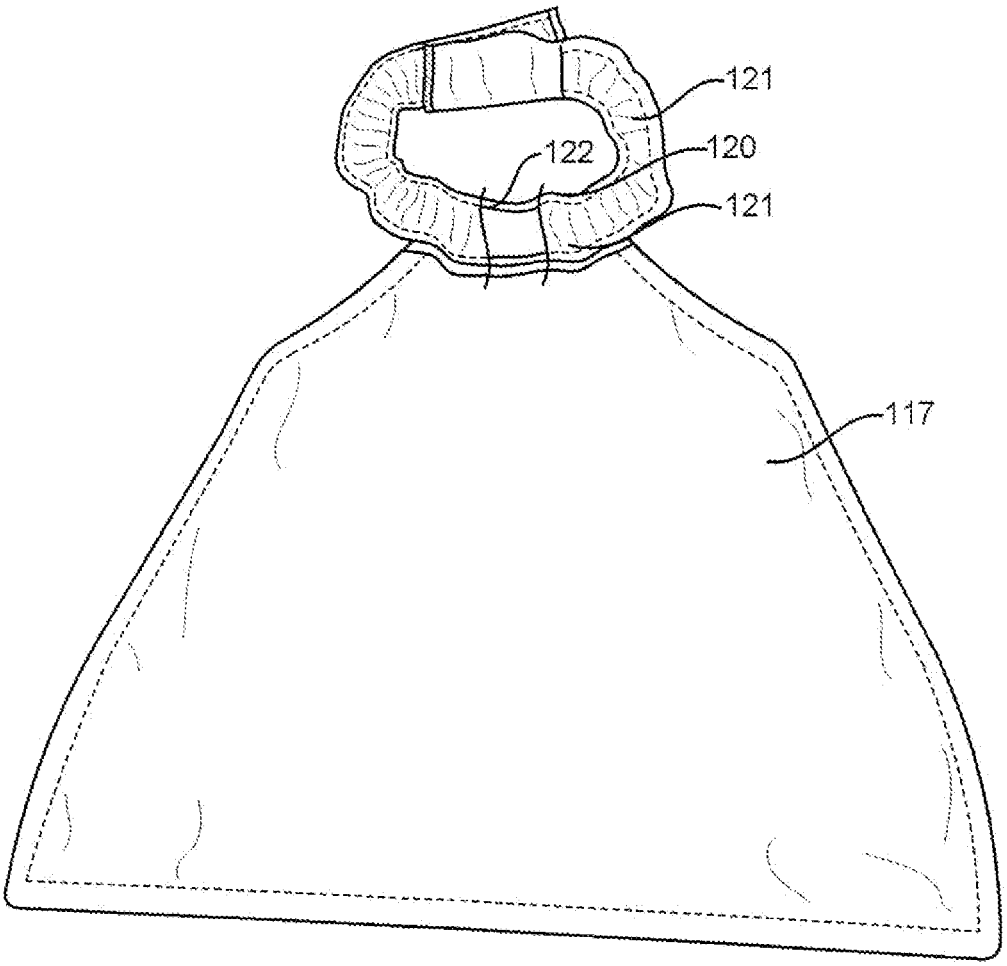
FIG. 3 is a rear view of the embodiment depicted in FIG. 1.

The wearable towel (110) having a front side (FIG. 2, 116) and a back side (FIG. 3, 117) is designed to cover the shoulders and back of the wearer. The front side (116) comprises a terry cloth and/or cotton towel material. The back side (FIG. 3) or under side (117) consists of a waterproof material permanently attached to the terry cloth and/or cotton towel material. The waterproof material may be a waterproof nylon fabric, waterproof polyester fabric. In one non-limiting example embodiment herein, the back (under) side includes a waterproof material such as a Polyurethane Laminate (e.g., a type of polyester). The wearable towel (110) may be in the shape of an isosceles trapezoid or modified isosceles triangle (see FIG. 2). The parallel sides (111, 114) of the wearable towel (110) comprise the bottom and top sides, respectively. The top side (114) is considerably shorter than the bottom side (111). It is envisioned that the measurement (w) of the top side is between four (4) and six (6) inches. The sizing is to allow the top side of the wearable towel to cover the neck of the user and flare out towards the bottom side (111). The bottom side is envisioned to be substantially longer (W) to preferably cover the user's back. The non-parallel sides (112, 113) of the wearable towel (110) are preferably angled such that the wearable towel (110) narrows near the top side (114). It is envisioned that the angle at which the wearable towel (110) flares out towards the bottom side (111) may be different along the length of the non-parallel sides (112, 113) such that the non-parallel sides may include a bend (115), such that the angle ($\alpha$) is greater near the top side (114) than the angle ($\beta$) at the bottom side (111). Other shapes are contemplated for the wearable towel (110). Table 1 provides a range of values for the length and width, dependant on the sizing. The sizing of the wearable towel may vary by up to 20%, plus or minus

TABLE 1

| SIZE | TOP SIDE WIDTH (w) | BOTTOM SIDE WIDTH (W) | LENGTH (L) |
|---|---|---|---|
| Small | 4 inches | 17 inches | 13 inches |
| Medium | 5 inches | 19 inches | 16 inches |
| Large | 6 inches | 21 inches | 19 inches |

The headband or elastic headband (120) consists of a stretchable material 122 (FIG. 3) and a sleeve (121) which encases the stretchable material. The sleeve may be made from the same terry cloth and/or cotton towel material as the wearable towel (110). The sleeve (121) is permanently attached to the top side (114). Specifically, the center portion (123) of the elastic headband is attached along the edge of the top side such that the elastic headband (120) extends equal lengths beyond the right and left edges of the top side. The stretchable material (122) is attached to the sleeve (121) at or near ends (124, 125). It is contemplated that each end (124, 125) of the elastic band extends between eight (8) and nine (9) inches beyond the top side of the wearable towel (110). The stretchable material (122) has a length of approximately twenty (20) inches and may have a high elasticity value such that it may be stretched an additional 10 inches. The length of the sleeve is capable of accommodating the "stretched" length of the stretchable material (122). Each end (124, 125) of the elastic headband (120) includes complementary patches of a hook and loop fastener material (126, 127), allowing the elastic band to be adjustable worn about the user's head.

The Towel Back (100) may be used by adults and children alike. The terry cloth and/or cotton towel material may come in a variety of colors and patterns. The children's version may also include animal ears (FIGS. 5 and 6, 128) on the elastic headband (120), such as bunny ears, cat ears, etc. with a corresponding animal tail (FIG. 5, 129) or large bow centered on the bottom side (111) of the wearable towel (110).

Figure 4:
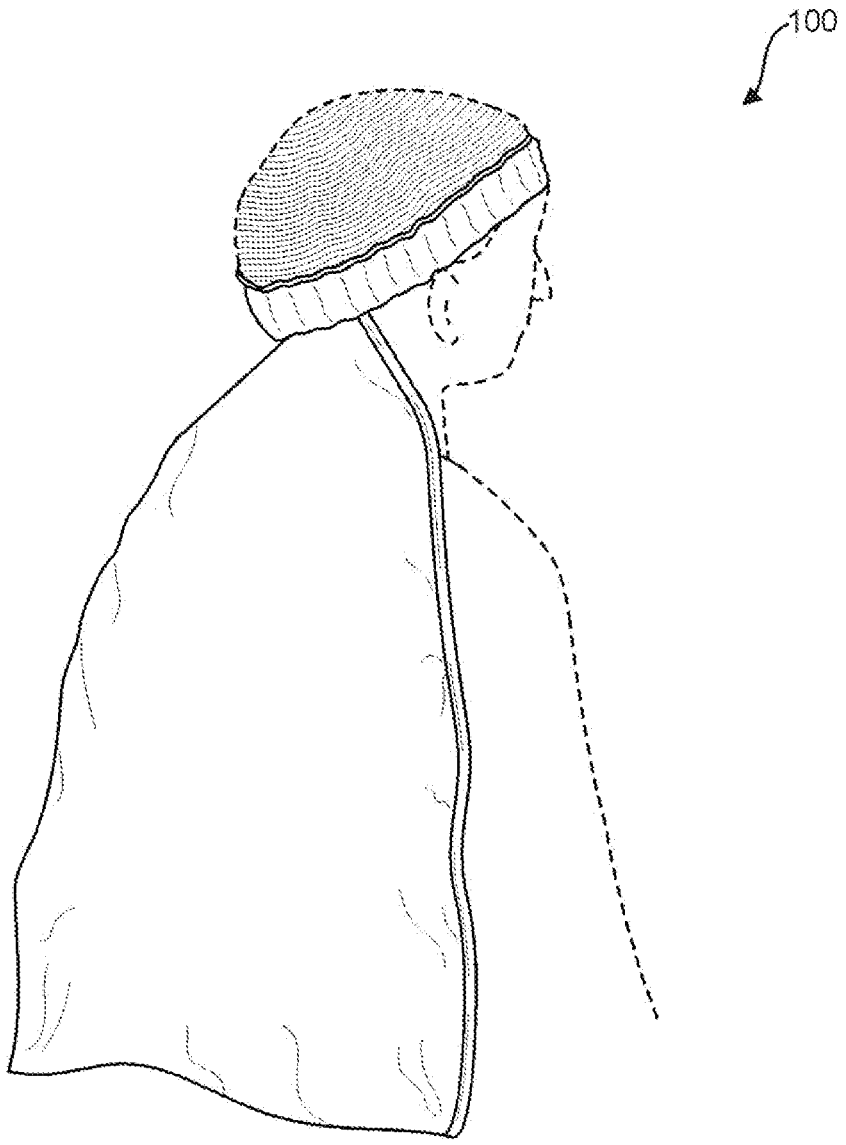
FIG. 4 is a perspective view of the embodiment depicted in FIG. 1 worn by a user.

As depicted in FIG. 4, the elastic headband (120) of the Towel Back is worn about the wearer's head, preferably the elastic headband (120) wraps around the head of the user, such that the elastic headband (120) is positioned just at the hairline of the user as the headband also serves to hold the hair away from the face. The wearable towel (110) rests on the shoulders and covers the wearer's back. The back side (117), comprising the waterproof material rests directly on the wearer's shoulders and back. While the front side (116) is positioned away from the wearer's body and is in contact with the wet hair. The wearer is able to adjust the tightness about which the Towel Back is secured by adjusting the hook and loop faster material located at either end of the elastic band (120). In this way, it is not necessary for the wearer to hold the Towel Back in place with one or both of her hands.

The wearer may alternatively wear the Towel Back about her neck, such that the elastic band (120) encircles the neck.

Figure 7:
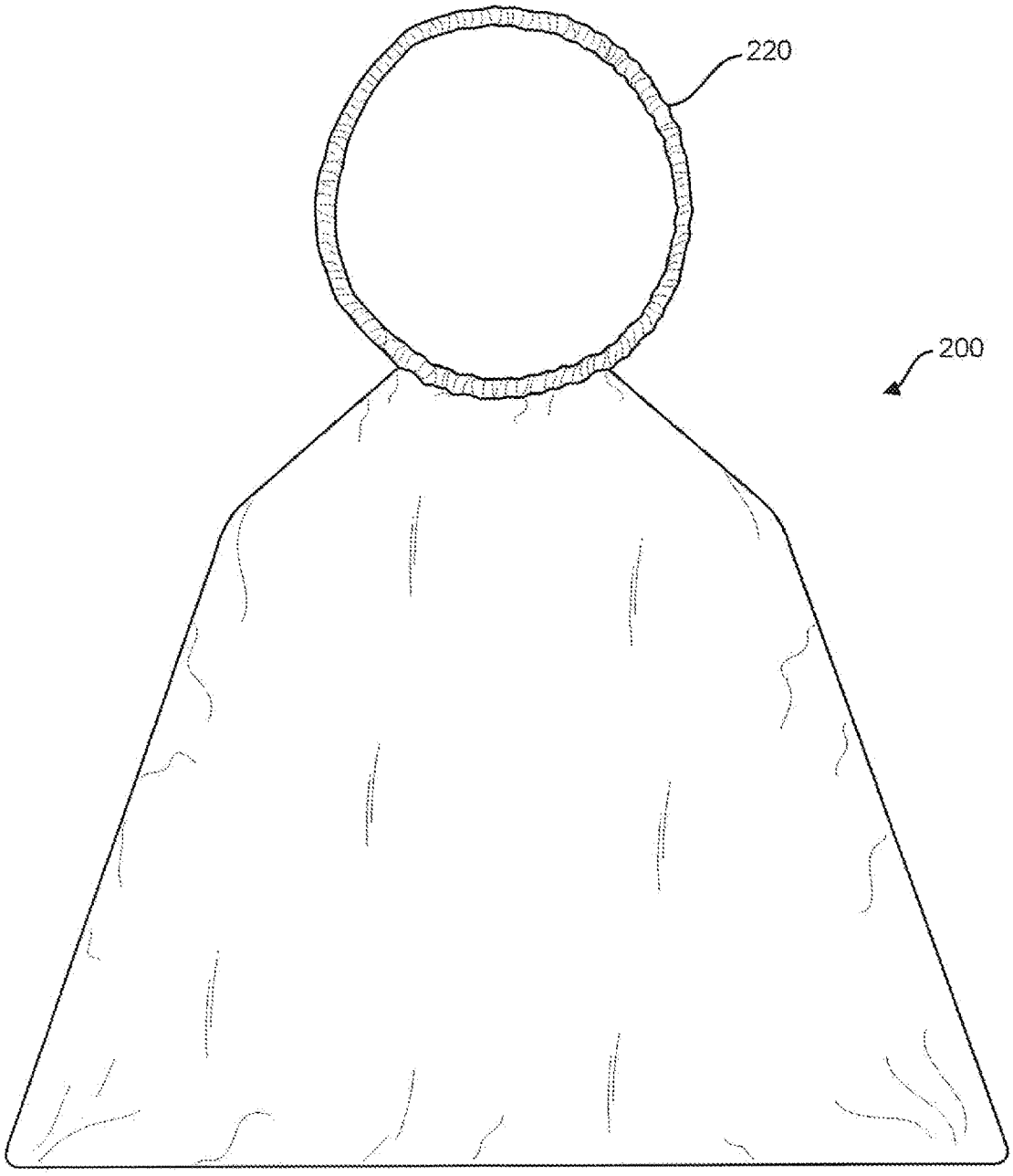
FIG. 7 is another embodiment of the present invention with enclosed headband.

An alternative embodiment of the present invention (200) (FIG. 7), the elastic headband (220) comprises a closed loop. Similar to the previous embodiment, the elastic headband consists of a sleeve and stretchable material. Because the elastic headband is a closed loop, there is no need for hook and loop fastener material.

At least some of the example embodiments herein enable the advantages and benefits relating to natural hair drying to be achieved. A natural drying process does not damage the hair as would, for example, an electric blow dryer, especially if the hair has been chemically treated. The hair exposed to the electric heat may become brittle, split at its ends or otherwise become damaged. Furthermore, using electric blow dryers can leave the hair frizzy and straighten otherwise natural curly or adversely affect a permanent wave (also known as a perm). Use of electric blow dryers confines a user to a location near an electrical outlet. Furthermore, the user's activity is limited to only drying one's hair when using an electric blow dryer. Active towel drying overcomes many of the disadvantages of electric blow dryers. Towel drying does not damage the hair, keeping the hair healthy. However, active towel drying takes time and prevents the user from performing other tasks. At least some of the example embodiments herein avoid or substantially minimize drawbacks associated with electric blow drying and towel drying.

Also, at least some of the example embodiments herein are advantageous for use with curly-haired (and wavy-haired) individuals. Oftentimes, in order to achieve defined curls or waves, such individuals air dry their hair. However, during air drying, one's back and clothing can become and/or remain wet. By virtue of using the example embodiments described herein, however, such issues can be avoided or substantially minimized and thus improve one's hair styling routine. By example only, a user can wear the Towel Back to dry the user's wet hair, without getting other body parts or clothing wet, and/or while avoiding or substantially minimizing or requiring any such wetness.

While the invention has been described with reference to specific embodiments, it will be appreciated that numerous variations, modifications, and embodiments are possible. Accordingly, all variations, modifications and embodiments are to be regarded as being within the spirit and scope of the invention.

The invention claimed is:

1. A wearable towel for air drying semicylindrical portions of individual strands of a user's head hair comprising:

a generally flat towel having a top side, a bottom side and a pair of non-parallel sides, comprising:

a front surface comprising an absorbent material; and a back surface comprising a substantially waterproof material;

an elastic headband attached to the top side; and a sleeve comprised of said absorbent material covering the elastic headband and attached to the top side, wherein the top side is shorter than the bottom side.

2. The wearable towel of claim 1, wherein the elastic headband has a first end having a patch of hook fastener material and a second end having a complementary patch of a loop fastener material, allowing the headband to have an adjustable circumference.

3. The wearable towel of claim 1, wherein the elastic headband is a stretchable closed loop.

4. The wearable towel of claim 1, wherein said absorbent material comprises cotton.

5. The wearable towel of claim 1, wherein said substantially waterproof material comprises polyester fabric.

6. The wearable towel of claim 1, wherein said generally flat towel has an isosceles trapezoid shape wherein:

the top side and the bottom side are parallel; and each of the non-parallel sides includes a respectively inward bend.

7. The wearable towel of claim 1, further comprising animal ears attached to the sleeve and a corresponding animal tail attached to the bottom side, wherein the animal ears and the corresponding animal tail are made from said absorbent material.

8. The wearable towel of claim 1, wherein the wearable towel has a size and a shape that enables air drying of semicylindrical portions of individual strands of the user's head hair while preventing the user's head hair from touching a neck of the user.

9. The wearable towel of claim 1, wherein:

the top side has a top width in the range of 4 to 6 inches;

the bottom side has a bottom width in the range of 17 to 21 inches; and a circumference of said elastic headband is greater than the top width.

10. The wearable towel of claim 1, wherein:

the top side has a top width between 3.2 and 7.2 inches;

the bottom side has a bottom width between 13.6 and 25.2 inches; and a circumference of said elastic headband is greater than the top width.

11. The wearable towel of claim 10, wherein each of the non-parallel sides has a length in the range of 13 to 19 inches.

12. The wearable towel of claim 10, wherein each of the non-parallel sides has a length between 10.4 and 22.8 inches.

13. The wearable towel of claim 1, wherein said absorbent material comprises terry cloth.

* * * * *